United States Patent [19]

Mendez

[11] Patent Number: 4,606,164

[45] Date of Patent: Aug. 19, 1986

[54] ROOF TILE

[76] Inventor: Fernando Mendez, 10370 NW. 135th St., Hialeah Gardens, Fla. 33016

[21] Appl. No.: 754,608

[22] Filed: Jul. 12, 1985

[51] Int. Cl.[4] ..... E04D 1/04

[52] U.S. Cl. ..... 52/536; 52/588; 52/595

[58] Field of Search ..... 52/536, 588, 593, 594, 52/595, 539

[56] References Cited

U.S. PATENT DOCUMENTS

| | | | |
|---|---|---|---|
| 152,991 | 7/1874 | Hamel | 52/536 |
| 522,686 | 7/1894 | Donalson et al. | 52/536 |
| 953,939 | 4/1910 | Arnold et al. | 52/536 |
| 1,555,087 | 9/1925 | Warren | 52/536 |
| 3,740,914 | 6/1973 | Diez | 52/536 X |
| 4,065,899 | 1/1978 | Kirkhuff | 52/536 X |

FOREIGN PATENT DOCUMENTS

| | | | |
|---|---|---|---|
| 162063 | 1/1949 | Austria | 52/536 |
| 1924185 | 11/1970 | Fed. Rep. of Germany | 52/536 |
| 2054041 | 5/1972 | Fed. Rep. of Germany | 52/536 |
| 45631 | 4/1966 | German Democratic Rep. | 52/536 |

*Primary Examiner*—J. Karl Bell

*Attorney, Agent, or Firm*—Jesus Sanchelima

[57] ABSTRACT

A roof tile of rectangular and flat shape that can be interlockingly disposed with longitudinally and laterally adjacent tiles. The tile includes a frame member mounted to the underside of a flat top member and the frame member being of smaller dimensions than the top member and positioned towards the rear portion of the top member, it provides an interlocking cavity towards the front section that houses the rear of a longitudinally contiguous tile. Lateral ribs and grooves cooperate to provide lateral interlock.

5 Claims, 7 Drawing Figures

ROOF TILE

BACKGROUND OF THE INVENTION

1. Field of the Invention

The present invention relates to roof tiles and more particularly to those tiles that are volumetric efficient and provide thermic insulation simultaneously.

2. Description of the prior art

Many different designs of roof tiles have been used in the past. All of them have the common purpose of shielding a dwelling from the elements. How this is accomplished in an efficient manner is what the present invention is all about so that the manufacturing cost, transportation and inventory logistics of the tile are optimized. Also, it is important to have a roof tile that is sturdy enough to withstand its handling and, when installed, the weight of workers on a roof.

Applicant believes that the closest reference corresponds to U.S. Pat. No. 522,686 issued to John E. Donaldson in 1894. However, it differs from the present invention because it did not achieve any material cost savings. Its panel B is merely raised and corresponds with recess B' . Donaldson's concerns were different than today's when economic considerations for storing, handling and transporting roof tiles play a major role.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a roof tile having the appearance of a honeycomb on one of its sides with the resultant savings in material, weight and transportation costs while maintaining mechanical and structural integrity substantially equivalent to conventional solid tiles.

It is another object of the present invention to provide a tile with thermic insulation features.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
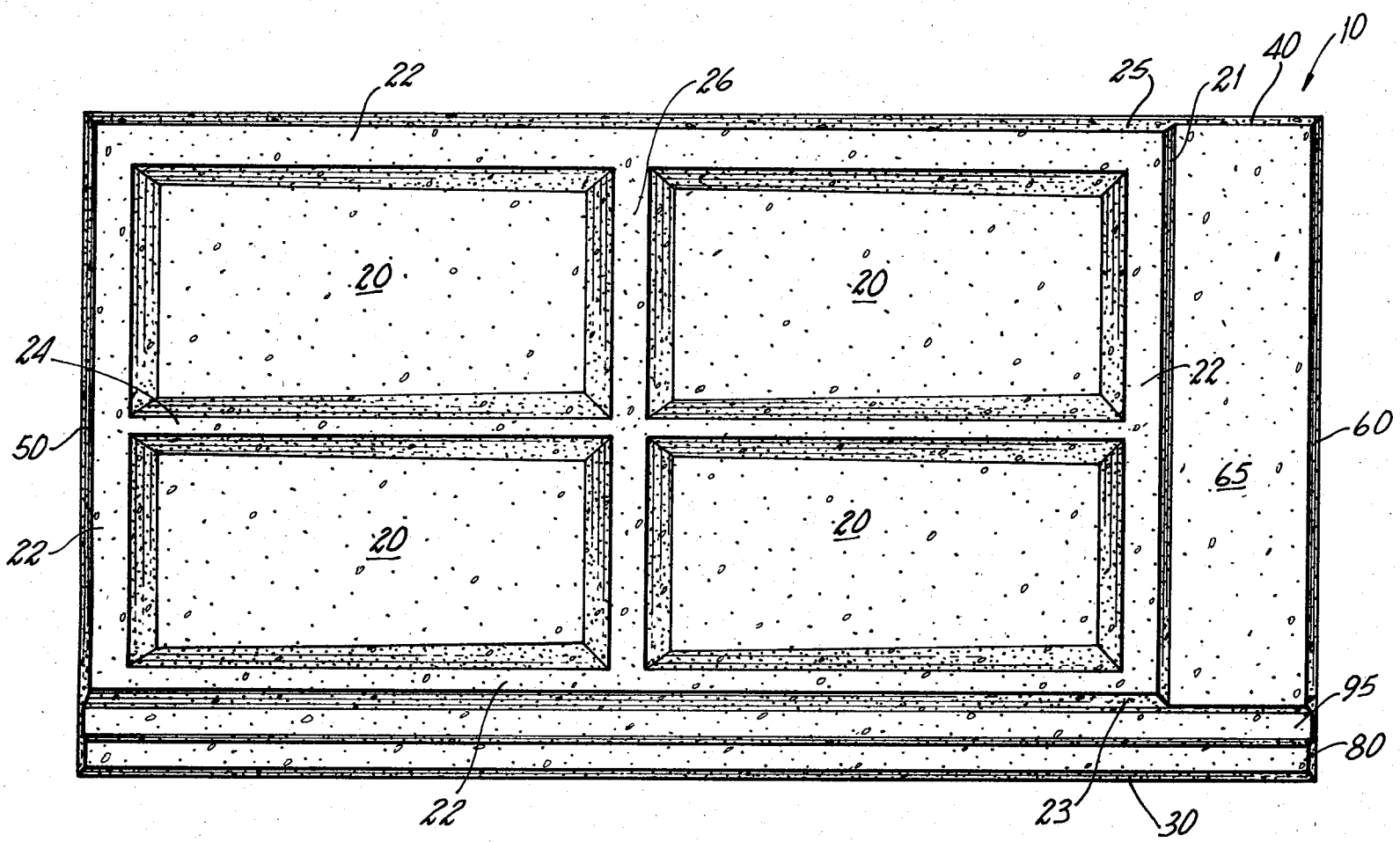
FIG. 1 represents a bottom view of the roof tile.
Figure 2:
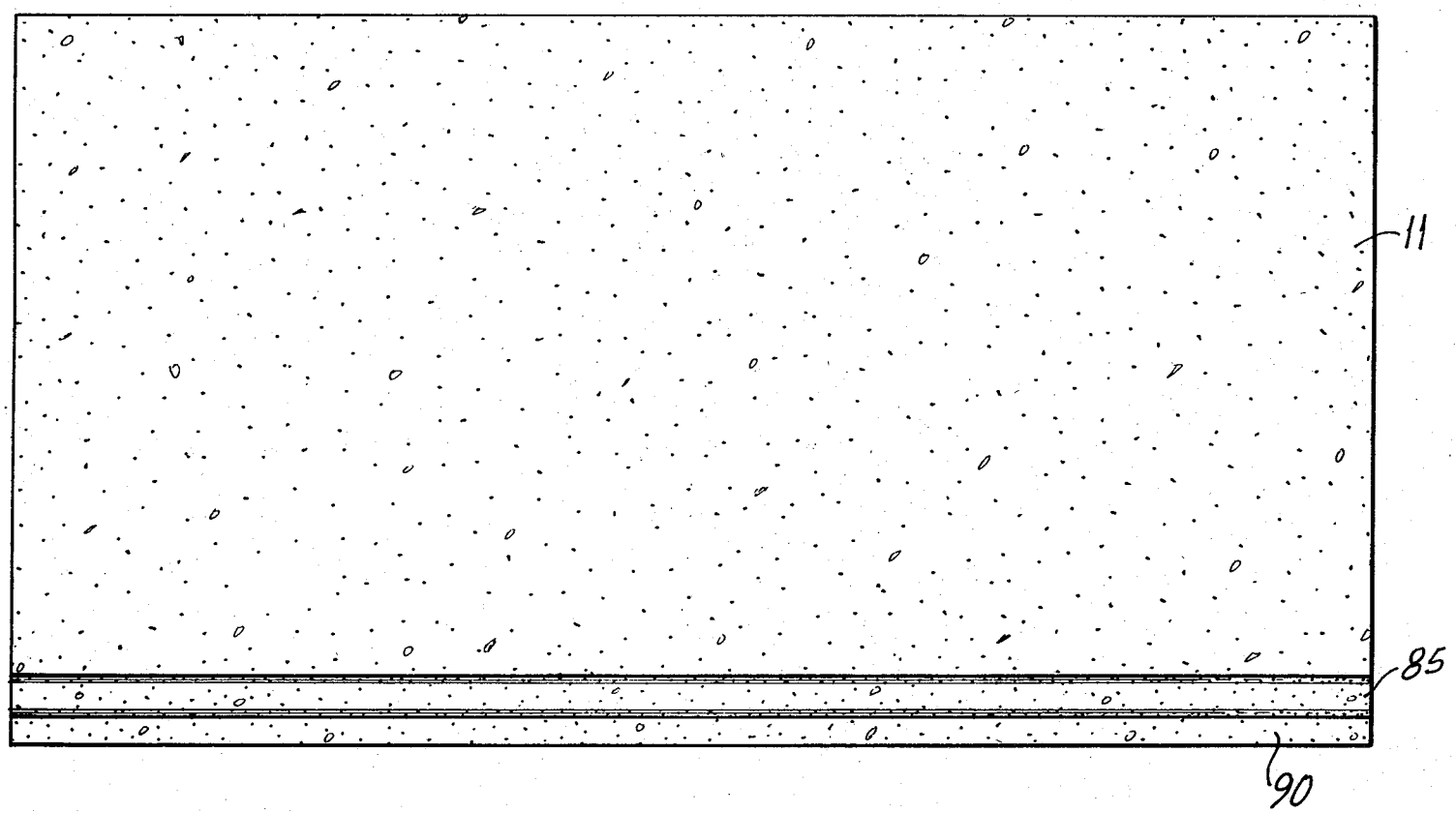
FIG. 2 shows a top view of the roof tile.

Referring now to FIG. 1, where the present invention is generally referred to with numeral 10, it can be observed that its underside has several cavities 20 that resemble a honeycomb. Frame 22 is longitudinally and laterally connected with ribs 24 and 26, respectively. The bottom most (closer to reader from FIG. 1) underside surfaces of frame 22, longitudinal rib 24 and lateral rib 26, are leveled so that the entire tile rests on these surfaces.

Figure 3:
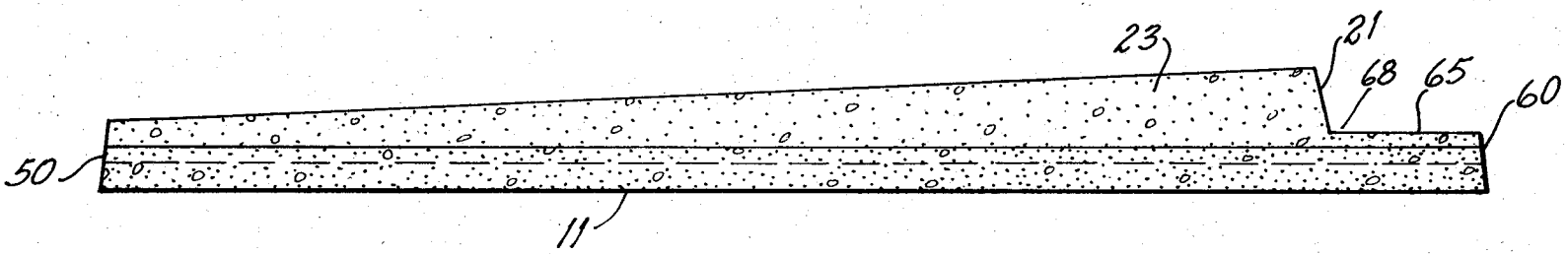
FIG. 3 illustrates an elevation view of the side of the roof tile.
Figure 4:
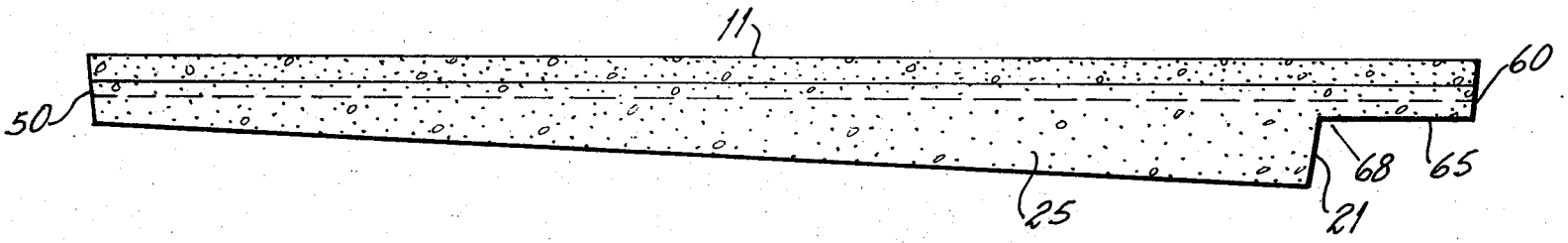
FIG. 4 is an elevation view of the right side of the roof tile.

As seen in FIGS. 3 and 4, tile 10 has a top member 11 of substantially rectangular shape and positioned above frame 22. Left side wall 30, right side wall 40, rear end wall 50 and front end wall 60 define top member 11. Top member 11 is substantially flat. All of these side walls are slanted towards the center of the tile when seen from the bottom as shown in FIG. 1. The slant is necessary to facilitate taking the tile out of the mold and it also saves material as space 99 shows in FIG. 7.

Surface 65 is recessed upwardly from the level of the underside surfaces of frame 22 and ribs 24 and 26 defining, with front frame side wall 21, interlocking cavity 68 as shown in FIGS. 1; 3 and 4. Interlocking cavity 68 is designed to house a portion of the tile (longitudinally contiguous) rear and the distance from side wall 21 to front end wall will determine how much of the rear portion of tile 10 is housed within cavity 68. Since the left and right side walls 23 and 25 of frame 22 have a wedge shape, they terminate, at the front end portion, inside cavity 68. In the preferred embodiment, rear wall 50 of one tile comes in contact with frame side wall 21 of the contiguous tile above it.

Figure 5:
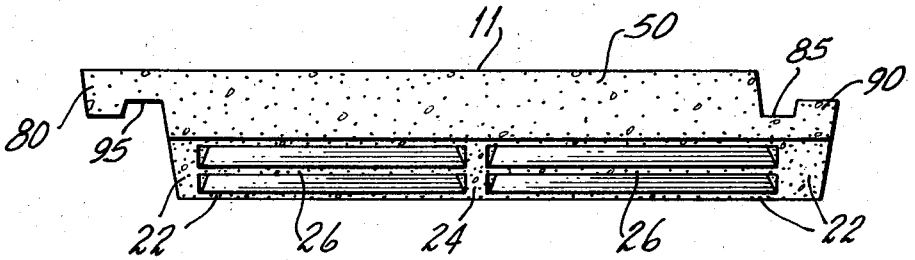
FIG. 5 shows a rear view of the tile.
Figure 7:
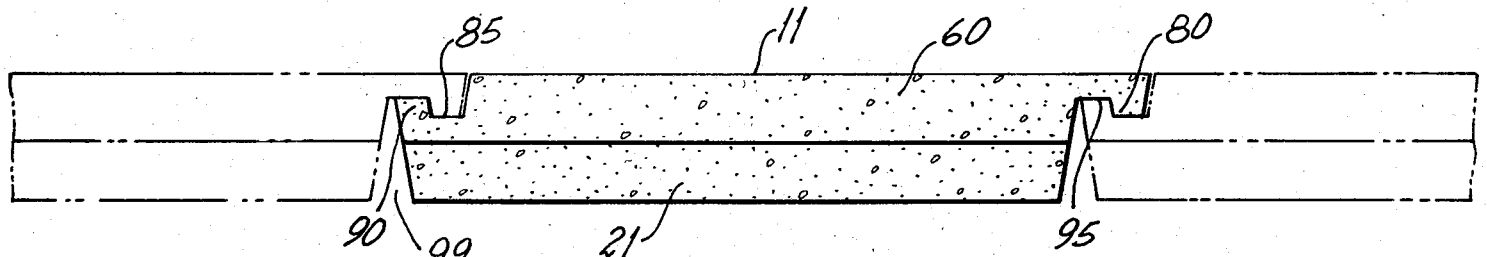
FIG. 7 illustrates the front view of a roof tile showing two laterally adjacent tiles, interlocked.

Bottom or underside lateral rib 80 is designed to interlock a contiguous tile to the right by fitting inside upper lateral groove 85, as shown in FIGS. 5 and 7. Upper lateral rib 90 interlocks with bottom lateral grove 95, as shown in FIGS. 5 and 7. There is a small clearance or space 99 which allows for variations of dimensions in the production line, thermal expansion and it also saves raw material. Rib and groove 80; and 95 have been incorporated on the left side of tile 10 and rib 90 and groove 85 have been incorporated in the right side of tile 10, in the preferred embodiment, but their positions may also be reversed.

Figure 6:
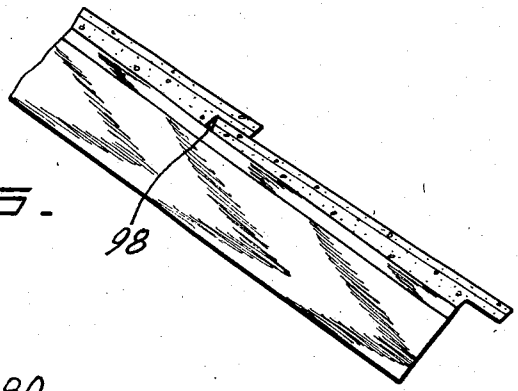
FIG. 6 is a side view of two tiles longitudinally interlocked.

A clearance or space 98 may be formed, as shown in Fig. 6, due to the slant mentioned above that is required in order to facilitate taking the tile out of the mold.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A roof tile, comprising:

A. a substantially rectangular top member having front, rear, left and right walls, and further including parallel to and substantially close to its right side, an upper lateral rib and groove members and said top member further includes cooperating underside lateral groove and rib members below said upper rib and groove members so that laterally contiguous tile may be interlockingly connected; and B. a substantially rectangular frame structure attached to the underside of said top member having longitudinal and lateral reinforcement members within said frame and defining at least four cavities, said frame structure being adjacent to said rear wall and having a smaller longitudinal length and width than said tile so that an interlocking cavity is formed with the front portion of the underside of said top member and said frame thereby allowing the housing of a portion of the rear part of a longitudinally contiguous tile within said interlocking cavity.

2. The tile set forth in claim 1 wherein said frame structure has a wedge like elevation shape thereby increasing the depth of the frame structure towards the front of said tile.

3. The tile set forth in claim 2 wherein said left, right, front and rear walls include sufficient slant towards the middle of the underside of said tile to effectively facilitate the extraction of the tile from the mold.

4. In a tile of the type used for roofing in dwellings and other structures, having a substantially flat and rectangular top member included a frame member of smaller dimensions mounted to the underside of said top member, wherein the improvement comprises:

A. means for interlocking longitudinally contiguous tiles, and

B. means for interlocking laterally contiguous tiles.

5. The tile set forth in claim 4 wherein said frame member includes a plurality of longitudinal and lateral reinforcement members defining a plurality of cavities.

* * * * *